US005896993A

United States Patent [19]

Nask et al.

[11] Patent Number: 5,896,993

[45] Date of Patent: Apr. 27, 1999

[54] STACKABLE RECEPTACLE ASSEMBLY FOR POURABLE PRODUCTS

[75] Inventors: Aleene F. Nask, West Harrison, N.Y.; Timmy L. Willett, Waverly, Ky.; Richard Rhodes, Northport, N.Y.

[73] Assignees: Olin Corporation, Cheshire, Conn.; Berry Plastics Corporation, Evansville, Ind.

[21] Appl. No.: 08/923,674

[22] Filed: Sep. 4, 1997

[51] Int. Cl.[6] ..... B65D 21/04

[52] U.S. Cl. ..... 206/508; 206/509; 220/254

[58] Field of Search ..... 206/508, 509, 206/511, 512; 220/254

[56] References Cited

U.S. PATENT DOCUMENTS

| | | | |
|---|---|---|---|
| D. 205,319 | 7/1966 | Klein | D58/17 |
| D. 218,359 | 8/1970 | Marsh | D49/35 |
| D. 231,184 | 4/1974 | Brown et al. | D7/189 |
| D. 248,090 | 6/1978 | Box | D9/237 |
| D. 270,675 | 9/1983 | Parker | D34/5 |
| D. 284,728 | 7/1986 | Trivison | D7/79 |
| D. 296,671 | 7/1988 | Jordan | D9/431 |
| D. 306,830 | 3/1990 | DeCoster | D9/435 |
| D. 307,716 | 5/1990 | Fitzloff et al. | D9/424 |
| D. 311,334 | 10/1990 | Flynn et al. | D9/424 |
| D. 313,555 | 1/1991 | Jordi | D9/424 |
| D. 316,674 | 5/1991 | Poirier | D9/424 |
| D. 322,760 | 12/1991 | Blanchette | D9/435 |
| D. 323,912 | 2/1992 | Delmerico | D34/5 |
| D. 323,914 | 2/1992 | Doxey et al. | D34/5 |
| D. 326,945 | 6/1992 | Howitt | D34/40 |
| D. 329,200 | 9/1992 | Collins | D9/454 |
| D. 330,674 | 11/1992 | Lyon | D9/420 |
| D. 351,791 | 10/1994 | Morris, Sr. | D9/425 |
| D. 351,792 | 10/1994 | Morris, Sr. | D9/425 |
| D. 353,743 | 12/1994 | Jochem et al. | D7/612 |
| D. 358,327 | 5/1995 | Tomasello | D9/424 |
| D. 362,180 | 9/1995 | Haines | D9/424 |
| 2,120,487 | 6/1938 | Conner | 220/66 |
| 2,436,097 | 2/1948 | Clarke | 65/59 |
| 2,780,259 | 2/1957 | Nalle, Jr. | 150/5 |
| 3,056,525 | 10/1962 | Deinert | 220/21 |
| 3,117,692 | 1/1964 | Carpenter et al. | 220/60 |
| 3,338,468 | 8/1967 | Wilson | 220/97 |
| 3,383,009 | 5/1968 | Weikert | 220/97 |
| 3,406,855 | 10/1968 | McKechnie | 220/1.5 |
| 3,419,184 | 12/1968 | Asenbauer | 220/97 |
| 3,447,714 | 6/1969 | Elliot | 220/97 |
| 3,526,334 | 9/1970 | Ashton et al. | 220/23.83 |
| 3,598,271 | 8/1971 | Holley | 215/41 |
| 3,759,416 | 9/1973 | Constantine | 220/97 |
| 3,957,097 | 5/1976 | Swett | 150/0.5 |
| 3,989,142 | 11/1976 | Gwilliam, Jr. et al. | 206/508 |
| 4,033,473 | 7/1977 | Raley et al. | 220/66 |
| 4,113,095 | 9/1978 | Dietz et al. | 206/508 |
| 4,286,713 | 9/1981 | Marchais | 206/508 |
| 4,288,000 | 9/1981 | Luker et al. | 220/281 |
| 4,632,268 | 12/1986 | Melzi et al. | 220/1 |
| 4,708,258 | 11/1987 | Shaw et al. | 220/288 |
| 4,779,754 | 10/1988 | Ten Eyck et al. | 220/66 |
| 4,819,795 | 4/1989 | Swaney | 206/278 |
| 4,986,433 | 1/1991 | Davis | 220/23.8 |

(List continued on next page.)

*Primary Examiner*—Joseph M. Moy
*Attorney, Agent, or Firm*—William A. Simons; Thomas F. Presson; Wiggin & Dana

[57] ABSTRACT

Pourable products such as pool chemicals are packaged in a rectilinear stackable receptacle assembly. The receptacle assembly includes an upper cover or lid which includes a stacking recess into which a second receptacle assembly can nest. The receptacle assembly also includes a lower bucket portion which includes a continuous sidewall forming a rectilinear shape. The cover and the bucket side wall include interlocking members thereon which securely attach the cover to the bucket when the cover is pressed down against the bucket. The cover may include a pivotable bail handle, and also includes opposed side handles. The receptacle may include wheels partially located inwardly from one of the walls and upwardly from the bottom of the bucket.

5 Claims, 6 Drawing Sheets

U.S. PATENT DOCUMENTS

| | | | |
|---|---|---|---|
| 5,143,219 | 9/1992 | Yates, Jr. | 206/508 |
| 5,199,570 | 4/1993 | McKenzie | 206/503 |
| 5,269,438 | 12/1993 | Kelsey | 220/766 |
| 5,310,074 | 5/1994 | Jochem et al. | 220/296 |
| 5,337,910 | 8/1994 | Picozza | 220/203 |
| 5,356,026 | 10/1994 | Andress et al. | 220/306 |
| 5,377,858 | 1/1995 | Morris, Sr. | 220/254 |
| 5,381,918 | 1/1995 | Dahl | 206/508 |
| 5,392,945 | 2/1995 | Syrek | 220/608 |
| 5,474,184 | 12/1995 | Manndler et al. | 206/508 |
| 5,535,910 | 7/1996 | Cassel | 206/508 |
| 5,593,060 | 1/1997 | Preytulla | 206/508 |
| B1 4,708,258 | 11/1987 | Shaw et al. | 220/288 |

STACKABLE RECEPTACLE ASSEMBLY FOR POURABLE PRODUCTS

TECHNICAL FIELD

This invention relates to a stackable package for dry pourable pool chemicals and, more particularly, to stackable modular package assembly having a lower container portion.

BACKGROUND ART

Receptacles for pourable products, such as pool chemicals, have typically taken the form of cylinders. The use of cylindrical receptacle configurations provides a readily transportable and stackable marketing and merchandising system, but they do not optimize utilization of shipping or merchandising shelf space. Cylindrical pool chemical packaging systems are visually acceptable but are expensive to ship due to their inefficient utilization of shipping space. Point-of-sale locations which have limited shelf space likewise cannot optimize whatever shelf space is available to display product when a cylindrical package is utilized. The more product a merchant can place on his or her shelves, the greater the opportunity for product sales.

What is needed is a spatially efficient receptacle for pool chemicals, or other pourable products, which receptacle presents a visually attractive package to the consumer; is easy to use by the consumer; occupies minimal volume for shipping and stacking; is stablely stackable; and maximizes the density of product on point-of-sale shelves.

DISCLOSURE OF THE INVENTION

The present invention is directed to a container assembly for pool chemicals or other pourable products that is securely stackable one atop another during shipment and at point of sale displays. The container assembly of this invention is generally rectilinear in configuration, and includes a cover assembly which is configured so as to telescopingly interfit with a bottom stacking flange on a similarly configured container which is positioned on top of the container assembly. The container assembly includes two major components, i.e., the upper cover assembly and a lower bucket component which holds the pourable product. After the bucket component is filled with product, the cover assembly is snap-fitted onto the bucket component so as to securely confine the product to the container assembly. The cover assembly includes a selectively removable closure cap which allows the product to be poured from the container assembly. The cover assembly and the bucket component are reinforced with a network of ribs so as to provide the necessary strength for the container assembly so as to allow up to about fifty pounds of product to be packaged therein, and which also allows the filled containers to be stacked one atop another. The cover assembly may include a bail handle pivotably attached to the cover assembly. The container assembly may also includes wheels journaled to the bottom thereof so that the container assembly may be easily transported by the user.

It is therefore an object of this invention to provide a compact and spatially efficient receptacle assembly for storing and dispensing a product such as a pool chemical or the like.

It is an additional object of this invention to provide receptacle assemblies of the character described which can be stacked on top of each other so as to form a space-conserving assemblage of receptacles.

It is a further object of this invention to provide a receptacle assembly of the character described wherein the receptacles can be securely stacked on top of each other due to the inclusion of mating stacking structures on vertically adjacent receptacles in a stack thereof.

It is another object of this invention to provide a receptacle assembly of the character described which is formed from two components, an upper cover assembly, and a lower bucket component, which, when assembled fit securely together.

It is yet another object of this invention to provide a receptacle assembly of the character described which can be readily filled with product and capped on an assembly line.

These and other objects and advantages of the invention will become more readily apparent from the following detailed description of the invention when taken in conjunction with the accompanying drawings, in which:

BEST MODE FOR CARRYING OUT THE INVENTION

Figure 1:
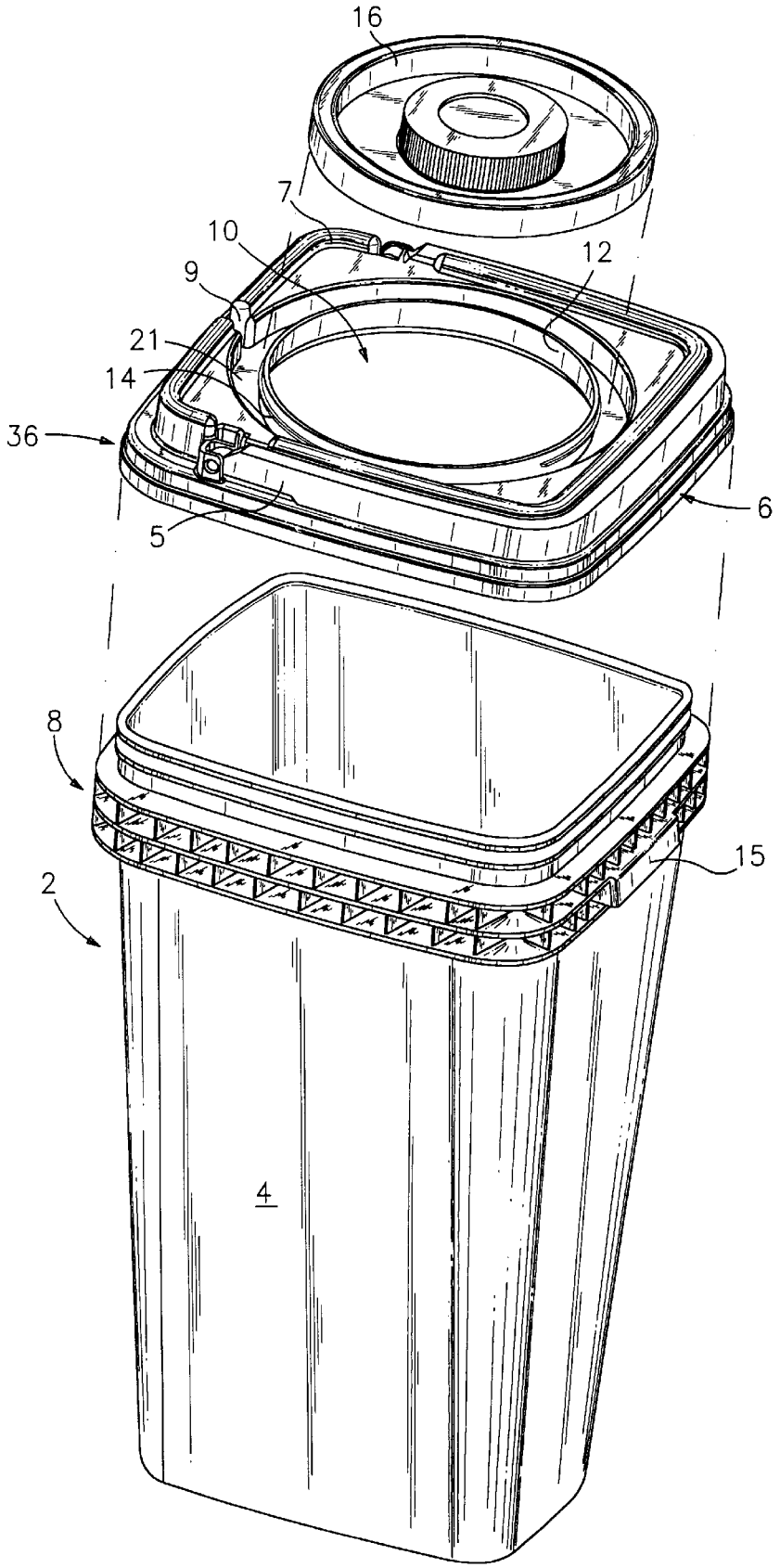
FIG. 1 is an exploded perspective view of a receptacle assembly which is formed in accordance with this invention.
Figure 2:
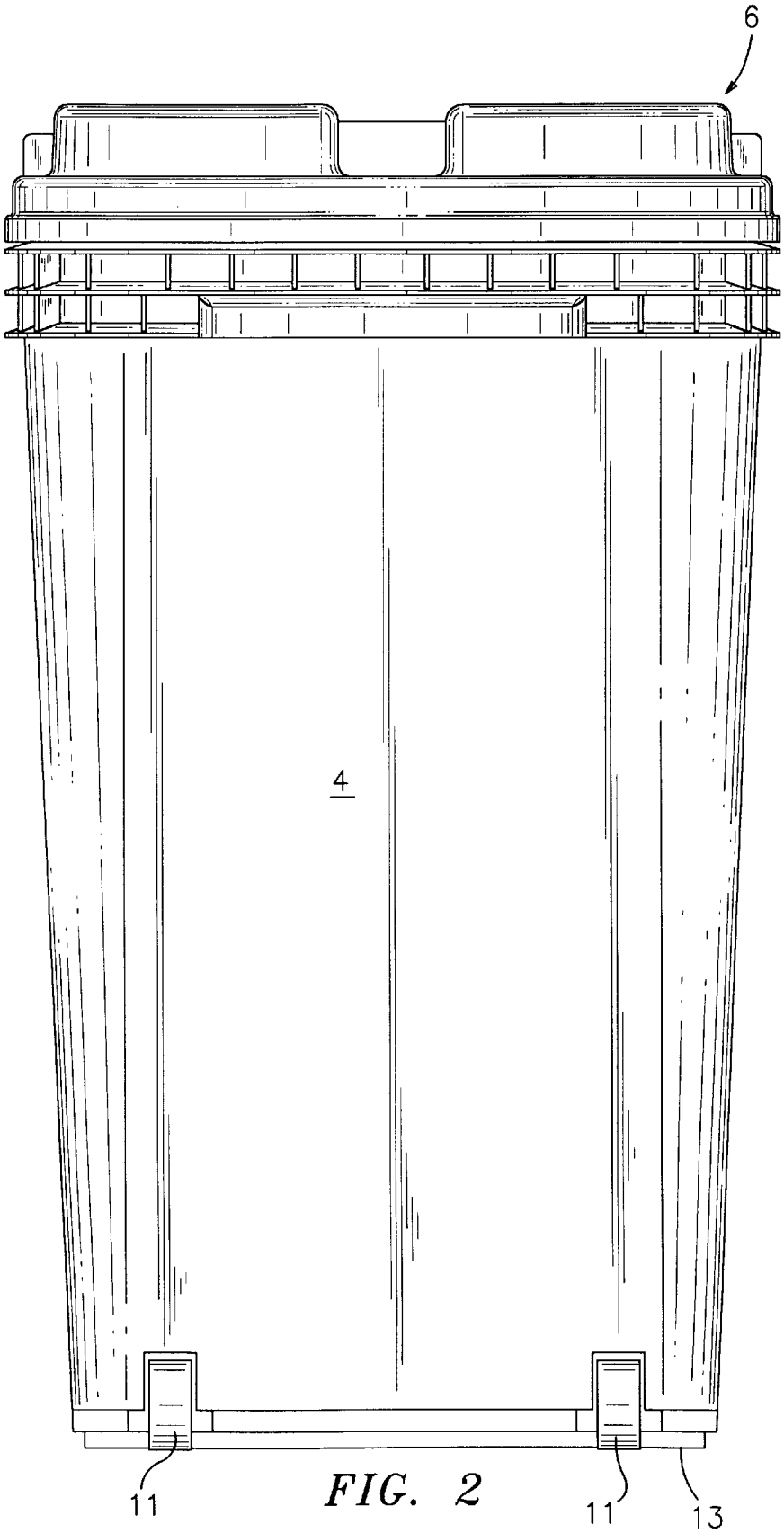
FIG. 2 is a side elevational view of the receptacle assembly as seem from the left hand side of FIG. 1.

Referring now to the drawings, a preferred embodiment of the receptacle assembly, which is denoted generally by the numeral 2, is shown in FIGS. 1 and 2. The receptacle assembly 2 includes a lower bucket 4 and an upper cover assembly 6. The bucket 4 is provided with a double ribbed outwardly projecting stabilizer flange complex 8 which serves to strengthen and stabilize the upper end of the bucket 4 of the assembly 2.

Figure 3:
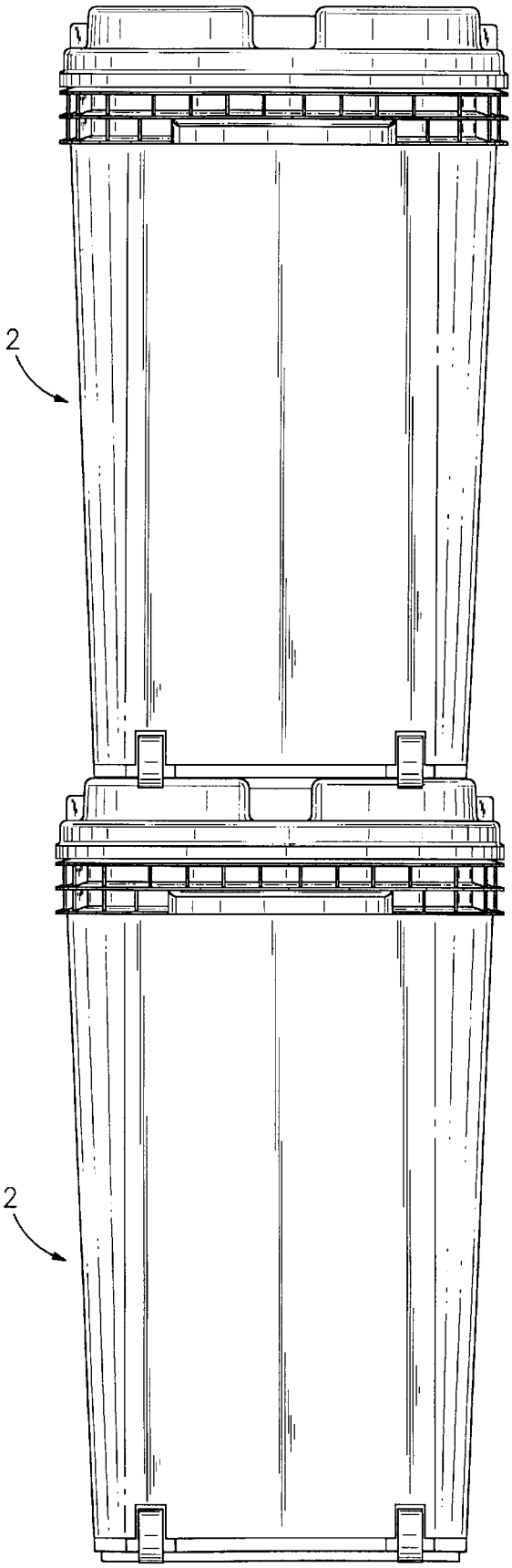
FIG. 3 is a side elevational view of two of the receptacle assemblies stacked one atop another.

The cover assembly 6 includes a dispensing opening 10 which is surrounded by a projecting neck 12 so as to form a product-dispensing spout. The neck 12 is provided with an outer broken thread 14 that facilitates securement of a closure cap 16 to the receptacle 2. The connection between the cap 16 and the neck 12 is preferably constructed in the manner described in U.S. Pat. No. 5,310,074, granted May 10, 1994 to D. J. Jochem et al, the disclosure of which is incorporated herein in its entirety. The cover assembly 6 may also include a handle 5 which is pivotally attached to the cover 6. A rectilinear stacking rib 7 is formed on the upper surface of the cover 6, and a water-passage slot 9 passes from an annular recess 21 through the rib 7 so that ambient water which may accumulate in the recess, for example from rain, can be easily poured off of the cover 6. The inner wall of the recess 21 is formed by the projecting neck 12. The bucket 4 includes a pair of wheels 11 whereby the receptacle 2 can be rolled over a surface by grasping the handle 5 and pulling the receptacle 2. As shown in FIG. 2, the bottom of the bucket 4 includes a downwardly projecting rectilinear stacking rib 21 which interfits with the stacking rib 7 on the cover assembly 6 in order for facilitate stable stacking of the receptacles 2 one atop the other, as shown in FIG. 3. The bucket 4 also includes a pair of opposed handles 15 on opposite sides thereof. It will be appreciated that the handle 5 will be used when moving the receptacle 2 on the wheels 11, and the handles 15 will be used when lifting the receptacle 2 to pour the product.

Figure 4:
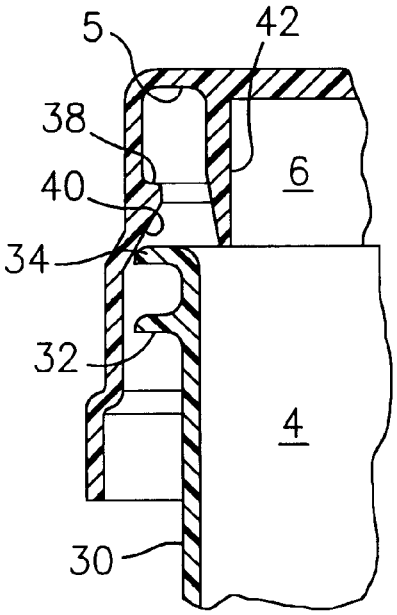
FIG. 4 is a fragmented sectional view of a locking mechanism by which the receptacle cover and bucket portion are firmly connected together prior to locking.
Figure 5:
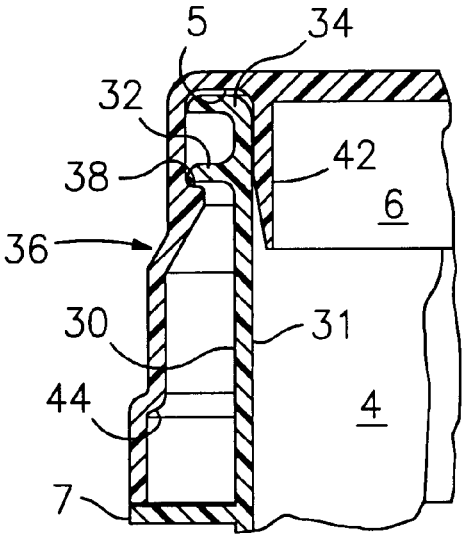
FIG. 5 is a view similar to FIG. 4, but showing the locking mechanism in its locked condition.

FIGS. 4 and 5 illustrate the interlocking mechanisms that are built into the bucket portion 4 and the cover portion 6 of the receptacle 2. The bucket side wall 30 includes an outwardly projecting latch ring 32 which is offset downwardly from the upper rim 34 of the bucket 4. The cover 6 includes an outer downwardly extending side flange 36 having an inwardly projecting catch ring 38 which is upwardly adjacent to a camming surface 40. The cover 6 also includes a downwardly depending wiper ring 42. Below the latch ring 32 and camming surface 40 is disposed a cover-centering ring 44 which serves to center the cover 6 relative to the bucket 4 as the former is lowered and pressed down upon the latter. FIG. 4 shows the cover 6 pressed down upon the bucket 4 with the catch ring 38 firmly locked against the latch ring 34. The wiper ring 42 is firmly pressed against the inner surface 31 of the bucket wall 30. It will be appreciated that when the cover 6 is pressed down upon the bucket 4, contact between the bucket rim 34 and the camming ring 40 will momentarily deflect the side flange 36 outwardly so that the latch ring 34 can slide past the bucket rim 34 and the catch ring 38. When the cover 6 is fully telescoped over the bucket 4 as shown in FIG. 4, the catch ring 38 will spring back to the latching position that is shown in FIG. 4.

Likewise, when the cover 6 is fully telescoped over the bucket 4 as shown in FIG. 4, the bucket rim 34 will be jammed against the under surface 5 of the cover 6 and the cover 6 will contact the bucket stabilizer flange 7, as shown in FIG. 4. Thus the cover 6 will be firmly attached to the bucket 4. The aforesaid securement mechanism allows the bucket 4 to be filled with product on a production line, and allows a subsequent closure of the bucket 4 with the cover 6 by simply pressing the covers 6 down upon the filled buckets 4 at a closure station on the production line. It will be noted that the fully assembled receptacle 2 is a torsionally stable product due in part to the several stabilizing flanges on the bucket 4 and stabilizing ribs on the cover 6, the latter being more clearly identified hereinafter.

Figure 6:
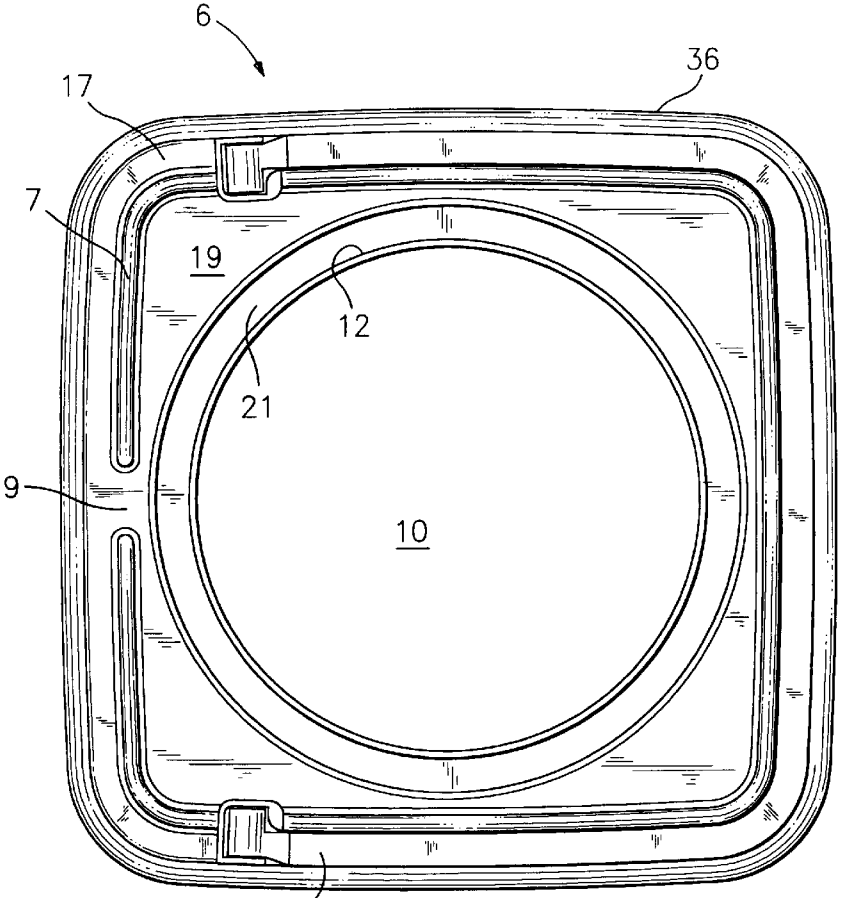
FIG. 6 is a plan view of the top cover assembly of the container assembly.

Referring now to FIG. 6, details of the top surface of the cover 6 are more clearly shown. The cover 6 includes the side flange 36 which merges into a horizontal flat 17, that, in turn, merges into the rectilinear stacking rib 7. Inwardly of the stacking rib 7 is disposed a recessed flat 19 which merges into a downwardly curved annulus 21 which surrounds the pour spout neck 12. As previously noted the product pouring opening 10 is centrally disposed on the cover 6. The spatial orientation of the handle 5 and the ambient water passage slot 9 on the cover 6 are also clearly depicted.

Figure 8:
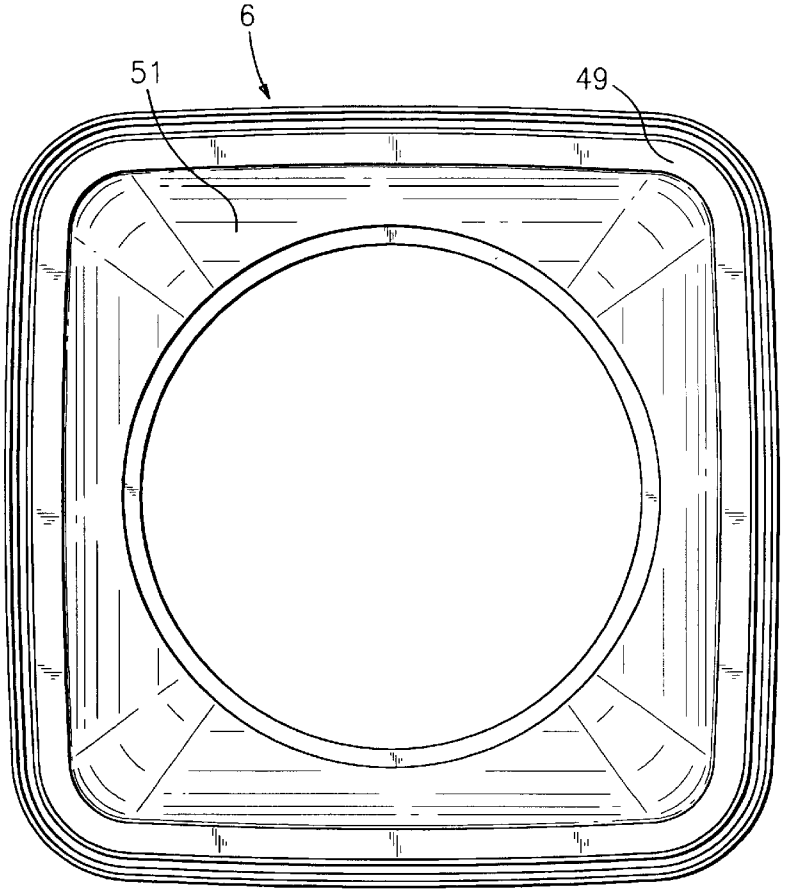
FIG. 8 is a plan view of the underside of the top cover assembly.
Figure 7:
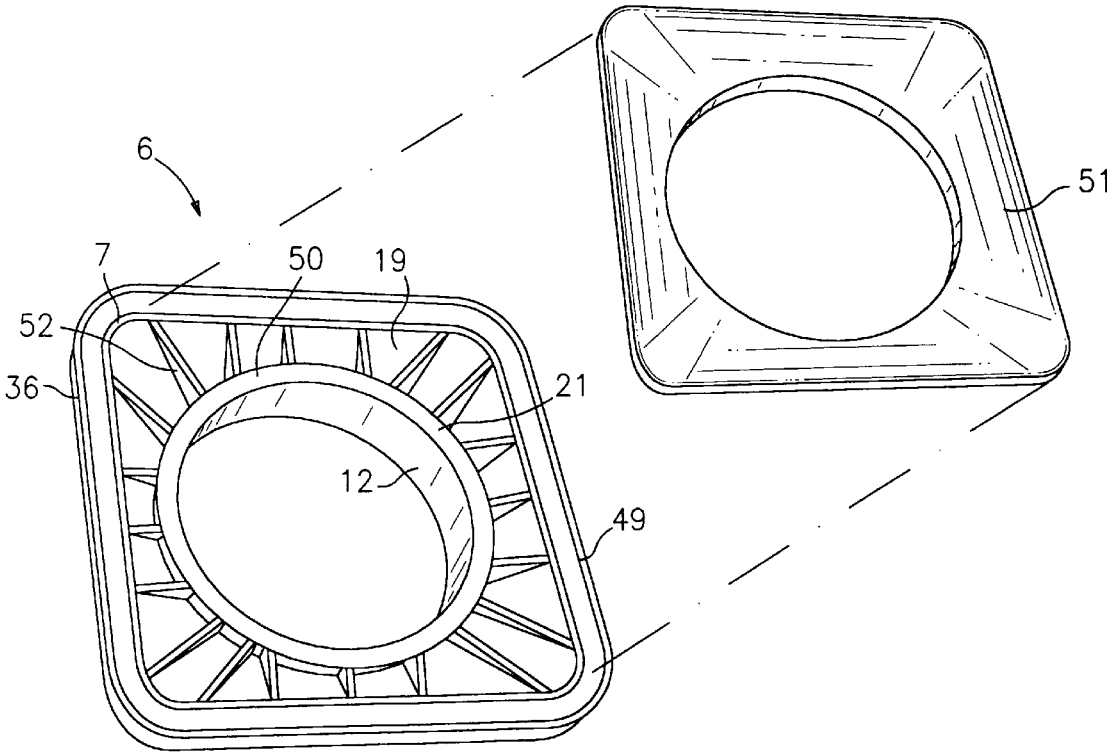
FIG. 7 is an exploded perspective view of the underside of the cover assembly.

Referring now to FIGS. 7 and 8, details of the construction of the underside of the cover 6 are disclosed. It will be noted that the cover 6 includes two components, i.e., a structurally reinforced outer member 49 and an inner shield member 51. The outer member includes the annular recess 21 which merges with the pour spout 12 and which provides structural strength to the center portion of the cover 6. The outer member 49 also includes a rectilinear rib 7 which lies radially outwardly of the recess 21. A network of radially extending ribs 52 interconnect the recess 21 and the rib 7 so as to stiffen the outer member 49 to a degree which allows the receptacles to be stacked ontop of each other without damaging the covers 6. As noted from FIG. 7, the ribs 7, 52 and the recess 21 combine to form pockets 19 in the underside of the outer member 49. The inner member 51 is smooth, and includes a central opening 54 which aligns with the pour spout 12 when the inner member 51 is placed over the outer member 49. The purpose of the inner member 51 is to prevent product in the receptacle 2 from becoming lodged in the pockets 19 when the product is poured from the receptacle 2, and to that end, the inner member 51 is secured to the outer member 49 by means of an adhesive or by means of spot or line fusion of the plastics from which the members 49 and 51 are formed. FIG. 8 illustrates the assembled top cover 6 with the inner member 51 secured to the outer member 49.

It will be appreciated that the receptacle assembly of this invention is spatially efficient, i.e., it occupies a minimum amount of shelf and storage space for any given volume of product. The assembly is easy to fill with product on a production line and easy to close. The receptacle assemblies are also structurally strengthened and can be securely stacked atop one another at the point of sale and when palletized for shipping.

Since many changes and variations of the disclosed embodiment of the invention may be made without departing from the inventive concept, it is not intended to limit the invention otherwise than as required by the appended claims.

What is claimed is:

1. A stackable receptacle assembly for the packaging of pourable products, said assembly comprising:

a) an upper rectilinear cover which includes:

i) a peripheral downwardly depending flange;

ii) a first stacking rib which is inwardly offset from said flange and which projects upwardly away from said flange;

iii) a circular downwardly extending recess which is inwardly offset from said first stacking rib;

iv) a cylindrical pouring spout which is inwardly adjacent to said circular recess and which extends upwardly away from said flange, said pouring spout having a thread formed on one surface thereof; and b) a lower rectilinear bucket including:

i) an upper edge which nests inside of said cover flange;

ii) a side wall which tapers downwardly from said upper edge to a bottom wall on the bucket; and iii) a second rectilinear stacking rib formed on said bucket bottom wall, said second stacking rib extending downwardly from said bucket bottom wall and being dimensioned so as to nest with said first stacking rib when one receptacle assembly is placed on top of another.

2. The receptacle assembly of claim 1 wherein said cover includes a closure cap threaded onto said pouring spout, said closure cap having an upper surface which is essentially coplanar with said first stacking rib.

3. The receptacle assembly of claim 1 wherein said cover includes an outer member on which said first stacking rib is formed, said outer member being provided with an inner rib which is disposed radially outwardly of said circular recess, and further including a plurality of stiffening ribs which extend from said inner rib to said circular recess and which are operable to structurally strengthen said cover.

4. The receptacle assembly of claim 3 wherein said cover includes an inner member which is secured to said outer member and which covers said stiffening ribs so as to prevent product contained in the receptacle assembly from lodging in pockets formed between said stiffening ribs when product is poured from the receptacle assembly.

5. A stackable receptacle cover assembly for the packaging of pourable products, said cover assembly comprising an outer rectilinear cover member which includes a peripheral downwardly depending flange, a first stacking rib inwardly offset from said flange which projects upwardly away from said flange, a circular downwardly extending recess which is inwardly offset from said first stacking rib, a cylindrical pouring spout inwardly adjacent to said circular recess which pouring spout extends upwardly away from said flange, said outer cover member also being provided with an inner rib which is disposed radially outwardly of said circular recess, and a plurality of stiffening ribs which extend from said inner rib to said circular recess and which are operable to structurally strengthen said cover assembly; said cover assembly also including an inner member which is secured to said inner rib, and which covers said stiffening ribs so as to prevent product from lodging in pockets which are formed between said stiffening ribs.

* * * * *